United States Patent [19]

Lemelson

[11] 4,121,376

[45] Oct. 24, 1978

[54] PROPELLER DRIVEN TOY

[76] Inventor: Jerome H. Lemelson, 85 Rector St., Metuchen, N.J. 08840

[21] Appl. No.: 787,928

[22] Filed: Apr. 15, 1977

Related U.S. Application Data

[63] Continuation-in-part of Ser. No. 563,365, Mar. 31, 1975, abandoned, which is a continuation-in-part of Ser. No. 361,050, May 17, 1973, Pat. No. 3,878,642.

[51] Int. Cl.[2] ..... A63H 23/14

[52] U.S. Cl. ..... 46/206; 46/96

[58] Field of Search ..... 46/206, 202, 96

[56] References Cited

U.S. PATENT DOCUMENTS

| | | | |
|---|---|---|---|
| 3,557,488 | 1/1971 | Nielson | 46/96 |
| 3,878,642 | 4/1975 | Lemelson | 46/206 |
| 3,885,346 | 5/1975 | Trattner | 46/206 |

*Primary Examiner*—Louis G. Mancene
*Assistant Examiner*—Robert F. Cutting

[57] ABSTRACT

A propeller driven toy is provided which is powered by a rubber band motor rotating a propeller which exerts a pushing thrust on the toy. The toy is in the form of a vehicle adapted to be driven across a surface as the rubber band motor unwinds. A lightweight body is composed of upper and lower body portions including a pod protruding above and to the rear of the lower body portion and containing the rubber band motor extending at least partially therethrough. The propeller is located at the rear of the pod beyond the rear end of the lower body portion. A motorized winding device for the propeller is also provided to rapidly condition the rubber band motor to drive the toy.

5 Claims, 4 Drawing Figures

PROPELLER DRIVEN TOY

RELATED APPLICATIONS

This is a continuation-in-part of Application Ser. No. 563,365 filed Mar. 31, 1975, now abandoned, which was a continuation-in-part of Ser. No. 361,050 filed May 17, 1973, now U.S. Pat. No. 3,878,642.

SUMMARY OF THE INVENTION

This invention relates to a self-propelled toy vehicle driven by thrust generated by a rotating propeller. Conventional propeller driven toys include model airplanes which are light in weight and require merely that the propeller generate sufficient thrust to overcome their resistance and generate lift. The rubber band motor is sufficiently light and imparts sufficient rotational energy to the propeller of a lightweight model airplane to sustain flight. However, such a rubber band powered propeller arrangement has not found acceptance for use in wheeled toy vehicles due to the fact that the thrust generated is generally not sufficient to either overcome friction at the wheels of the vehicle or to propel the vehicle at a generally acceptable speed.

Battery-operated electric motor-driven propeller driven wheeled toy vehicles have been made in which wires extend from a hand held battery to the vehicle and have been limited in their mode of operation. The weight of even the smallest conventional toy batteries is such as to increase the friction at the wheels and provide a load which is too great for the thrust of the propeller to properly overcome to suitably drive the vehicles. Accordingly it is a primary object of this invention to provide new and improved structures in propeller driven, wheeled toy vehicles.

Another object is to provide a propeller driven wheeled toy which operates at substantial speed and is realistic in appearance and operation.

Another object is to provide a propeller driven toy vehicle which is sufficiently light in weight so as to offer little frictional resistance to its movement across a surface yet is substantially strong enough to prevent it from being easily destroyed or damaged.

Another object is to provide a propeller driven toy vehicle employing a rubber band motor which is easily accessible from the exterior of the vehicle so that the motor may be replaced without difficulty.

Another object is to provide a rubber band operated propeller driven racing car toy which is realistic in appearance yet is structured to receive and retain a rubber band therein substantially the length of the body of the racing car.

Another object is to provide a new and improved structure in a profile racing car toy driven by a propeller.

Another object is to provide a new and improved apparatus for rapidly winding a rubber band motor of a propeller driven toy.

With the above and such other objects in view as may hereinafter more fully appear, the invention consists of the novel constructions, combinations and arrangements of parts, as described in the Specification and illustrated in the drawings, but it is to be understood that changes, variations and modifications may be resorted to which fall within the scope of the invention as claimed.

Figure 1:
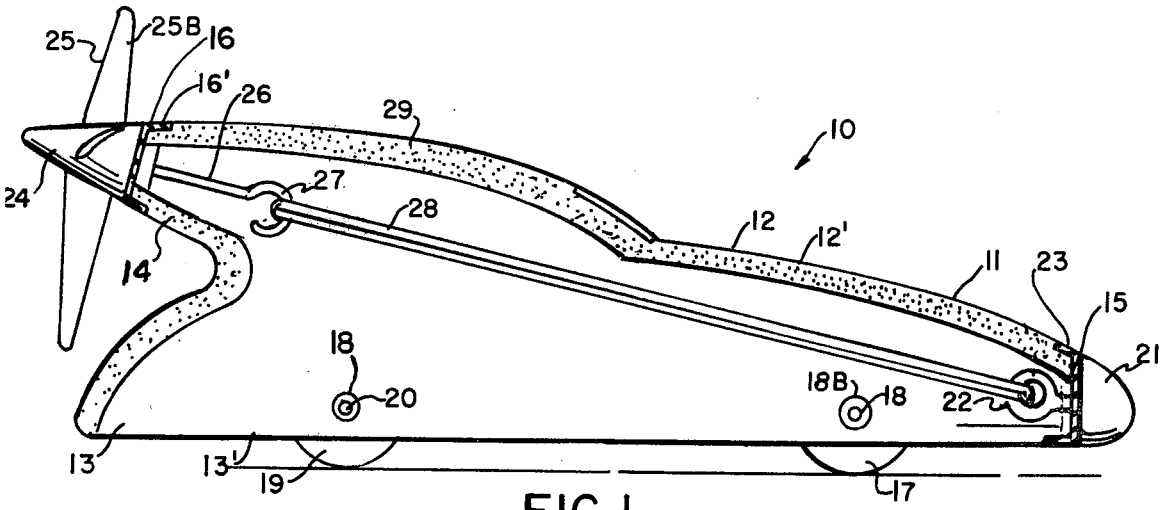
FIG. 1 is a side view with parts broken away for clarity of a propeller driven toy vehicle.
Figure 2:
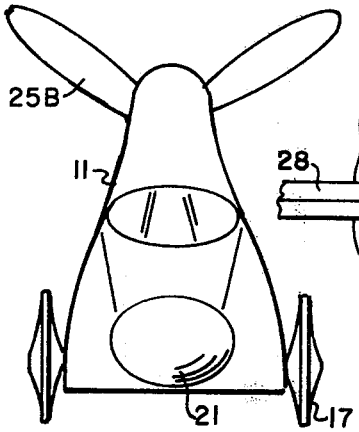
FIG. 2 is a front view of the toy of FIG. 1.
Figure 4:
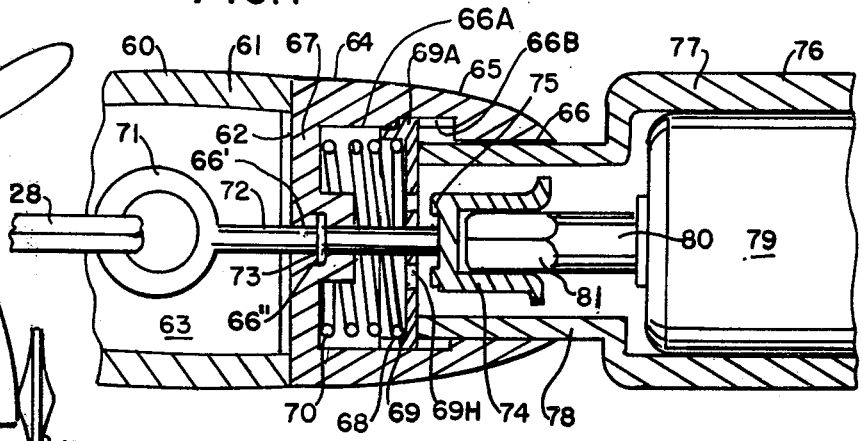

FIG. 4 is a side view with parts broken away for clarity of a modified form of toy vehicle propelled by the thrust of a rubber band driven propeller showing details of an electric motor operated hand held winding unit for the rubber band and FIG. 5 is an isometic view of a modified form of the vehicle toy of FIGS. 1 and 2 wherein the body of the vehicle and supports for the wheels thereof are made of sheet material defining the vehicle's profile.

The instant invention is concerned primarily with the construction of a light weight toy vehicle which is propelled by the thrust generated by a propeller preferably located at the rear of the vehicle and operated in a pushing mode as it rotates about as axis as a light weight rubber band motor unwinds. Important features of the invention include, in addition to producing the vehicle toy in a structure and of materials which are sufficiently light enough in weight to maintain friction at the wheel bearings and between the wheels and the ground at a minimum value, the provision of such a vehicle toy with a rubber band motor of sufficient length to provide thrust for an extended period of time sufficient to effect propulsion of the vehicle for distances of 25 to 50 feet across a flat surface to provide sufficient play value and permitting the toy to be raced with other similar toys.

While the bodies of the vehicle toys of the instant invention are preferably made of light weight plastic such as thin walled molded plastic or sheet material, they may also be made of foamed cellular plastics which are light in weight and of sufficient rigidity to support the wheels and propeller or light weight sheet metal such as aluminum.

Several configurations are illustrated in the accompanying drawings which may employ any of the aforementioned materials and which may be modified in shape and contour without departing from the spirit of the invention.

In FIG. 1 and 2 is shown details of one form of the invention comprising a vehicle toy 10 having a lightweight hollow body 11 composed of a main body portion 12 and a rear body portion 14 supporting a propellor 25 on hub 24 for rotation at the end thereof. Forward thrust to drive the vehicle is generated as the propellor shaft 26 is rotated when an elongated rubber band motor 28 unwinds. Pairs of front and rear wheels 17 and 19 are supported on axles 18 and 20 extending through the side walls of the main body portion 12 and preferably rotate freely on said axles. The wheels are relatively light in weight and thin at their peripheries offering minimum friction and resistance to travel across a smooth surface. Similarly, the vehicle body 11 is of a lightweight construction so that minimum friction between the wheels and the floor and the wheel bearing surfaces will develop, thus permitting the low thrust generated by the propellor to rapidly accelerate and move the vehicle. The vehicle body 11 is shown molded of lightweight foamed plastic such as expanded polystyrene of sufficient density and rigidity to support the tensioned rubber band motor at both ends and to resist the rigors of general play use. The body may also be made of a lightweight molded plastic shell formed of such material as high impact polystyrene, cellulose acetate or other suitable plastic.

A skin 29 of unexpanded plastic such as polystyrene or polyethylene is shown covering the outer surface of the cellular plastic portion of the body and may be provided by molding. The bottom 13 of the main body 12 is shown as having an opening 13' therein to permit easy access to the rubber band motor and its fittings although a wall may extend completely or partially across the bottom body opening. Plastic bushings 18B are provided between the front and rear axles 18 and 20 and the side walls of the main bodypportion 12 to provide support which the foam plastic would not provide. Tubing supported across the body by the sidewalls thereof may also be provided to support the axles 18 and 20.

The propeller blades 25B, which may be two or more in number, are preferably between 1 and 2 inches in length for a typical toy vehicle configuration. The propellor 25 must therefore be mounted to rotate in line with or above the upper part of the main vehicle body portion 12. To maintain body configuration somewhat simulating that of an automobile or race car, while providing sufficient space within the body to accommodate and elongated rubber band 28 of sufficient length, the rubber band extends along an axis which is inclined downwardly from the end of the rear body portion 14 to the front end of the vehicle, as shown. Since the propeller shaft 26 is directed along the same axis, thrust is directed forwardly and downwardly which also tends to help retain the vehicle on its travel surface. As a result of this arrangement, front end 12' of the main body portion 12 of the vehicle may be configured to resemble the front end of an automobile race car.

The propeller hub 24 is supported for low frictional rotation on a lightweight fitting 16 which is preferably molded of plastic and has a side wall 16' which circumscribes a portion of the rear end of body portion 14. The fitting 16 may be bonded or frictionally secured to the end of the rear body portion 14. If skin 29 is of suitable thickness, it may eliminate the need for such a fitting 16. The propeller shaft 26 is secured to the hub 24 and has a loop or hook formation 27 at its end to which one end of the rubber band motor is attached.

The other end of the rubber band 28 is attached to a hook or eye 22 extending from the nose plug 21 which is secured to the front end of the body portion 12 or frictionally held within the fitting 23 secured to the opening in the front end of the body.

The body configuration of the toy of FIGS. 1 and 2, if closed at the bottom or otherwise shaped to permit it to float upright, may also be designed to represent a boat or a land-sea vehicle whereby rotation of the propeller will drive the vehicle across a body of water. The propeller is disposed sufficiently high above the body to prevent it from striking the water.

Figure 3:
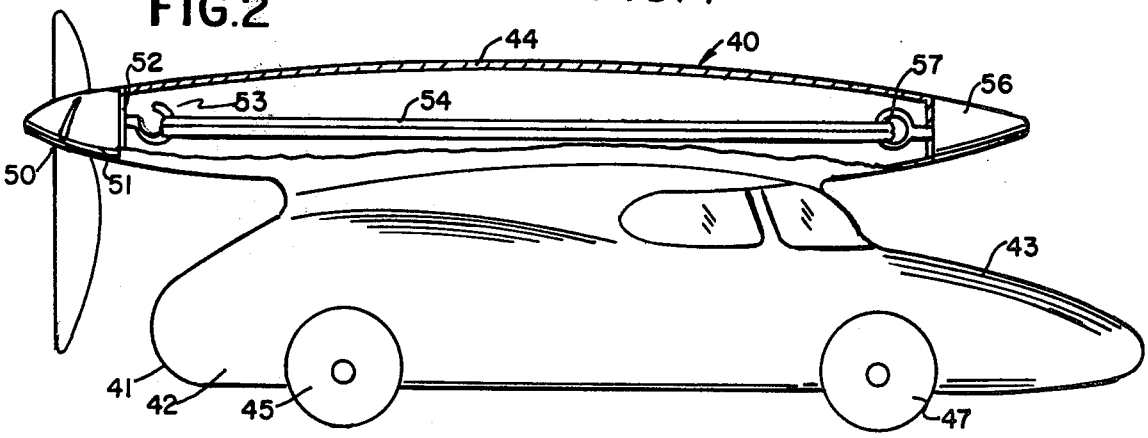
FIG. 3 is a side view with parts broken away of a modified form of the propeller driven toy.

In FIG. 3 is shown another configuration 40 in a toy vehicle having a body 41 composed of a main body portion 42 of lightweight hollow shell-like configuration and an enlarged tubular pod 44 disposed above and forming part of the vehicle toy body and extending most of, if not the entire length of the vehicle body. The front end or hood portion 43 of the body 42 is shown extending forwardly of the front end 56 of pod 44 which is disposed just above the cockpit. Front and rear wheel pairs 45 and 47 are rotatably supported on axles 46 and 48 supported by the body and a rubber band motor 54 is connected between the hook 53 of the propeller shaft 52 and a hook 57 connected to the front end 56. A propeller hub 51 is rotatably supported at the rear end of pod 44 by a thrust bearing BB disposed between the end wall 55 and hub 51. A propeller 50 is supported by hub 51 behind the rear end 42 of body 41. The body 41 of FIG. 3 may be constructed such that it will float the toy vehicle upright on a body of water with the propeller 50 thereof clearing the upper surface of the water to permit it to propel the vehicle across the surface of the water as it is rotated and generates thrust with the unwinding of the rubber band motor 43.

In FIG. 4 is shown a portion of a rubber band operated toy such as the toys of FIGS. 1 and 3 or a model airplane, provided with a power operated winding device for the rubber band thereof. The toy, denoted 60, is composed of a body shell 61 such as the hereinbefore described vehicle body or pod having at one end thereof an assembly 64 composed of a specially shaped cowling 65 having an end wall 67 which abuts the end 62 of body shell 61 and is cemented or otherwise fastened thereto. A large opening 66 is provided in the cowling 65 and extends to the end wall 67 and a smaller bore 66' extends axially through end wall 67. The shaft 72 of an eye or hook 71 extends through bore 66' and is free to rotate within the bore, its longitudinal displacement being limited by a lip or washer 73 secured to said shaft and slidably supported within an enlarged portion 66'' of the bore 66. A cup-shaped head 74 is secured to one end of shaft 72 and contains one or more pin-like protrusions 75 in its bottom wall. A second cup-shaped receptacle 68 has a side-wall 69 which is slideable in the end most portion 66A of the large bore 66 and is urged towards the outermost end of said bore portion 66A by a coil spring 70 which is always compressed thereby against the end wall 67. The recepticle 68 is restrained from rotation by a radial extension 69A of the head of recepticle 68 which rides in a longitudinal channel 66B formed in the wall defining bore 66 and limits the sliding movement of recepticle 68. When the rubber band 28 is tensioned as for example, when it is wound, it pulls on hook 71 drawing the cup shaped member 74 against recepticle 68 whereby the protrusions 75 thereof are drawn into the openings 69H in the end wall of the recepticle 68 thereby preventing rotation of shaft 72.

The winding device 76 which is employed to rotate shaft 72 and thereby wind the rubber band motor 28 is preferably a manually held winder containing a suitable battery operated gear motor 79 and a push button, monostable switch (not shown) for starting and stopping said motor. The motor 79 is supported within a housing 77, the forward end 78 of which is shaped to conform to the shape of bore 66. The outer shaft 80 of motor 79 is disposed within forward end 78 and is externally shaped in a rectangular configuration 81 such that it will conform to similarly shaped surfaces of the wall of cup shaped head 74 and may be used to power rotate same and the shaft 72 attached thereto. The end portion 78 of housing 77 is of such a length as to cause it to depress recepticle 68 thus disengaging the protrusions 75 from the holes 69 in the end wall of cup-shaped recepticle 68 and permitting recepticle 74 to rotate together with shaft 72 attached thereto since shaft 80 of motor 79 is inserted within & coupled to rotate recepticle 74 when the end portion 78 forces uncoupling of 74 from 68, operation of motor 79 thereafter will rotate shaft 72 thereby winding the rubber band 28. If the other end of the rubber band 28 is connected to the propeller shaft, by holding the propeller from rotation, the rubber band may be automatically and rapidly wound up. However, if assembly 64 is supported by means of a suitable thrust bearing for rotation at the end of the vehicle or airplane body 61, it may be used to support propeller blades for driving the vehicle.

When the end portion 78 of housing 77 is removed from bore 66, spring 70 forces recepticle 68 outwardly causing it to engage the end of recepticle 74 whereafter the protrusions 75 of the latter fall into holes 69H or engage protrusions formed in the face of 68 thereby coupling the shaft 72 and eye 71 to the assembly 64.

In FIG. 5 is shown a modified form of toy vehicle 80 of the type illustrated in FIGS. 1 and 2 wherein the body 81 is sheet-like in configuration and has a T-like cross section along most, if not all, of its length. The body 81 is composed of a vertically extending portion 82, at the bottom of which and extending laterally therefrom is a horizontally extending sheet-like portion 91. The vertically extending sheet-like portion 82 is configured to represent the side-view contour of a racing car, while the horizontal shell portion 91 serves to stiffen the vehicle body and serve as a support for bearing means for the front and rear wheels. The front end 83 of the body 82 contains arcuate opening 86 therein to accommodate the single front wheel 95 for rotation on a shaft 94 supported at its ends by bosses 93 which are molded integral with the horizontal body portion 91. Notation 92 refers to an opening in the horizontal shelf portion 91 accommodating wheel 95 which rotates on an axle 94 supported at its ends on bosses 93 which project above shelf 91 and may be molded integral therewith. Two rear wheels 96A and 96B are each rotatably supported on an axle which rotates within an elongated boss 97 molded integral with shelf 91 and fillets 90 which extend from opposite sides of body portion 82.

I claim:

1. A vehicle toy having a rigid body formed of a lightweight hollow shell-like assembly, said assembly including a lower body portion having wheels rotatably supported thereby for wheeled movement of said toy across a surface, an upper body portion attached to and projecting above said lower body portion and defining a hollow pod extending at least partly along the length of said lower body portion, a rubber band motor extending longitudinally through said pod, means for anchoring one end of said rubber band motor to the front end of said hollow pod upper body portion of said vehicle, a propeller and a propeller shaft connected to said propeller with which shaft said propeller is rotated, bearing means at the other end of said pod supporting said propeller, means attaching said propeller shaft to said rubber band motor, said propeller having a length such that when it rotates on said bearing means and is driven when said rubber band motor unwinds after being wound up, the propeller will clear the surface along which said vehicle moves as said wheels rotate and will provide sufficient thrust for driving said vehicle toy across said surface.

2. A vehicle toy in accordance with claim 1 wherein said upper body portion of said shell-like assembly is an elongated pod substantially the length of said lower body portion with the rear portion of said upper body portion supporting said propeller behind and above the rear end of said lower body portion.

3. A vehicle toy in accordance with claim 2 wherein the line of thrust of said propeller supported by said upper body portion is substantially parallel to the surface on which the vehicle travels.

4. A vehicle toy in accordance with claim 2 wherein said upper body portion supports said propeller at its rear end for rotation behind the rear end of said lower body portion and extends partly the length of said lower body portion.

5. A vehicle toy in accordance with claim 1 in which the lower body portion is capable of floating on water and disposes the upper body portion sufficiently above the surface of the water to permit said propeller to be rotated to power drive the toy across said water as said rubber band motor unwinds, without the propeller striking the surface of the water.

* * * * *